US010638899B2

(12) United States Patent
Noh et al.

(10) Patent No.: US 10,638,899 B2
(45) **Date of Patent: *May 5, 2020**

(54) CLEANER

(71) Applicant: LG ELECTRONICS INC., Seoul (KR)

(72) Inventors: Dongki Noh, Seoul (KR); Jongwoo Han, Seoul (KR); Seungmin Baek, Seoul (KR); Hyungrock Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 512 days.

This patent is subject to a terminal disclaimer.

(21) Appl. No.: 14/701,918

(22) Filed: May 1, 2015

(65) Prior Publication Data

US 2015/0313432 A1 Nov. 5, 2015

(30) Foreign Application Priority Data

May 2, 2014 (KR) ..... 10-2014-0053668

(51) Int. Cl.

| | |
|---|---|
| ***A47L 9/28*** | (2006.01) |
| ***A47L 5/36*** | (2006.01) |
| ***A47L 9/30*** | (2006.01) |

(52) U.S. Cl.

CPC ..... *A47L 5/362* (2013.01); *A47L 9/2805* (2013.01); *A47L 9/2826* (2013.01); *A47L 9/2852* (2013.01); *A47L 9/30* (2013.01); *A47L 2201/04* (2013.01)

(58) Field of Classification Search

None

See application file for complete search history.

(56) References Cited

U.S. PATENT DOCUMENTS

2002/0138936 A1 10/2002 Takeuchi et al.
2012/0320206 A1* 12/2012 Sim ..... H04N 5/222 348/148

FOREIGN PATENT DOCUMENTS

| | | | | |
|---|---|---|---|---|
| EP | 2420170 | A1 | 2/2012 | |
| EP | 2420171 | A1 | 2/2012 | |
| KR | 20100060582 | A | 6/2010 | |
| KR | 20120017847 | A | 2/2012 | |
| KR | 101318071 | B1 | 10/2013 | |
| WO | 02074150 | A1 | 9/2002 | |
| WO | WO 2007051972 | A1 * | 5/2007 | ..... G01C 21/00 |

OTHER PUBLICATIONS

Office Action of Korean Patent Office in Appl'n No. 10-2014-0053668, dated May 27, 2015.

* cited by examiner

*Primary Examiner* — Brian D Keller

(74) *Attorney, Agent, or Firm* — Dentons US LLP

(57) ABSTRACT

A cleaner is disclosed. The cleaner method includes a movable body configured to be movable for suctioning dust and a following body for collecting the dust suctioned by the movable body, the following body being mobile, wherein the following body includes an image acquisition unit for acquiring an image for a view around the following body and a controller for controlling the following body to travel while following the movable body based on the acquired image.

4 Claims, 13 Drawing Sheets

CLEANER

CROSS-REFERENCE TO RELATED APPLICATION

This application claims priority under 35 U.S.C. § 119 to Korean Patent Application No. 10-2014-0053668, filed on May 2, 2014 in the Korean Intellectual Property Office, whose entire disclosure is incorporated herein by reference.

BACKGROUND

1. Field

The present invention relates to a cleaner.

2. Background

A cleaner is an apparatus that suctions dust from floor. In general, the cleaner includes a suction device having a suction port for air suction and a main body connected to the suction device via a hose defining an air suction channel. The main body is provided with an air suction fan for generating negative pressure to suction air through the suction port, and the suction device or the main body is provided with a dust collector for collecting dust introduced through the hose.

The suction device is moved by a user, and the main body follows the suction device. Generally, the main body is moved by tension applied from the hose. In recent years, there has been developed a cleaner including a motor mounted in the main body for rotating wheels of the main body such that the main body can move for itself.

In addition, there is known a cleaner including an ultrasonic transmitter provided at the suction device and an ultrasonic receiver provided at the main body such that the main body actively follows the suction device based on ultrasonic waves received through the ultrasonic receiver. However, the ultrasonic receiver may receive ultrasonic waves reflected by an obstacle or a wall within a cleaning zone with the result that the main body may not properly follow the suction device.

SUMMARY OF THE INVENTION

Therefore, the present invention has been made in view of the above problems, and it is an object of the present invention to provide a cleaner configured such that a following body (or a main body) actively follows a movable body (or a suction device) with higher following ability than in a conventional cleaner.

It is another object of the present invention to provide a cleaner configured such that the following body can accurately follow the movable body in various cleaning zones.

It is another object of the present invention to provide a cleaner configured such that position information of the movable body is acquired from an image taken from a cleaning zone, and the following body actively follows the movable body based on the position information.

It is a further object of the present invention to provide a cleaner configured such that interference between a movement line of a user and a movement route of the following body is reduced.

In accordance with an aspect of the present invention, the above and other objects can be accomplished by the provision of a cleaner method including a movable body configured to be movable for suctioning dust and a following body for collecting the dust suctioned by the movable body, the following body being mobile, wherein the following body includes an image acquisition unit for acquiring an image for a view around the following body and a controller for controlling the following body to travel while following the movable body based on the acquired image.

The cleaner may further include a marker disposed at the movable body, wherein the following body may further include a travel unit for providing drive force for the following body to travel, and the controller may include a marker information acquisition module for acquiring position information of the marker in a real space based on a position of the marker indicated in the image, a travel operation setting module for setting a travel operation of the following body such that the following body follows the movable body based on the position information, and a travel control module for controlling the travel unit according to the set travel operation.

The position information may include at least one of a distance from the following body to the marker and a direction in which the marker is positioned relative to the following body.

The marker information acquisition module may further acquire movement information of the marker in the real space based on a change in position of the marker indicated in the image, and the travel operation may be set based on the position information and the movement information. The movement information may include at least one of a change in distance from the following body to the marker and a change in movement direction of the marker.

The marker information acquisition module may further acquire information regarding a change in attitude of the marker in the real space based on a change in shape of the marker indicated in the image, and the travel operation may be set based on the position information and the attitude change information. The attitude change information may include information regarding rotation of the marker. The marker may include two marker components constituting an identification pattern. The marker information acquisition module may acquire rotation information of the marker for a horizontal axis perpendicular to a direction in which an optical axis of the image acquisition unit is directed in the real space based on a change in distance between the two marker components indicated in the image. The marker information acquisition module may acquire the rotation information of the marker for the horizontal axis in the real space based on a change in vertical distance between the two marker components indicated in the image.

The marker information acquisition module may acquire rotation information of the marker for a vertical axis perpendicular to a direction in which an optical axis of the image acquisition unit is directed in the real space based on a change in distance between the two marker components indicated in the image. The marker information acquisition module may acquire the rotation information of the marker for the vertical axis in the real space based on a change in horizontal distance between the two markercomponents indicated in the image.

The marker may include three marker components constituting an identification pattern, the three marker components being arranged in a triangular shape. The marker information acquisition module may acquire the rotation information of the marker for an axis orthogonal to an optical axis of the image acquisition unit in the real space based on a change in distance from one of the three marker components indicated in the image to a segment formed by the other two of the three marker components.

The marker information acquisition module may further acquire information regarding a change in distance from the marker to the following body in the real space based on a change in area of a region defined by the three marker components indicated in the image.

The marker may reflect light around the marker to have an identity of higher luminance than a background. The cleaner may further include a lighting device for illuminating the marker.

The marker may include a light source for electrically emitting light.

The marker may include a plurality of marker components constituting an identification pattern, and at least two of the marker components may have different colors.

The marker may include a plurality of marker components constituting an identification pattern, and at least two of the marker components may have different shapes.

The cleaner may further include a marker disposed at the following body such that the marker is positioned within a visual field of the image acquisition unit. The marker information acquisition module may acquire information regarding a change in distance from the movable body to the following body in the real space based on a change in distance between the marker disposed at the movable body and the marker disposed at the following body in the image, and in a case in which the distance change information reflects that the movable body becomes distant from the following body, the travel operation may be set such that the following body is moved forward to the movable body.

The marker information acquisition module may acquire information regarding a change in direction of the movable body in the real space based on a horizontal displacement of the marker disposed at the movable body relative to the marker disposed at the following body in the image, and the travel operation may be set such that the following body turns in the changed direction of the movable body.

The following body may further include a pattern light irradiation unit for irradiating light constituting a pattern ahead of the following body, and the controller may include an obstacle information acquisition module for acquiring obstacle information in the real space based on a change in geometry of the pattern in the image. The obstacle information may be acquired based on the change in geometry of the pattern at a lower area of the image, and the position information of the marker may be acquired based on the position of the marker at an upper area of the image.

The cleaner may further include a hose for guiding the dust suctioned by the movable body to the following body, wherein the movable body may include a suction device having a suction port, through which the dust is suctioned, and the following body may include a main body for providing suction force via the hose such that the dust can be suctioned through the suction port.

The cleaner may further include a marker configured to be displaced according to movement of the movable body, wherein the controller may control the travel operation of the following body based on a position of the marker indicated in the image. In addition, the cleaner may further include a hose for guiding the dust suctioned by the movable body to the following body, wherein the movable body may include a suction device having a suction port, through which the dust is suctioned, the following body may include a main body for providing suction force via the hose such that the dust can be suctioned through the suction port, and the marker may be disposed at least one of the suction device and the hose.

The suction device may include a suction unit at which the suction port, through which the dust is suctioned, is formed, an intake pipe extending from the suction unit for defining a channel along which the dust suctioned through the suction port moves, and a handle provided at an upper part of the intake pipe such that a user holds the handle to move the suction device, and the marker may be disposed at the handle. The cleaner may further include a marker disposed at the main body such that the marker is positioned within a visual field of the image acquisition unit, wherein the controller may control the main body to travel while following the handle based on a change in distance between the marker disposed at the main body and the marker disposed at the handle in the image.

BRIEF DESCRIPTION OF THE DRAWINGS

The embodiments will be described in detail with reference to the following drawings in which like reference numerals refer to like elements wherein.

DETAILED DESCRIPTION

Advantages, features and methods for achieving those of embodiments may become apparent upon referring to embodiments described later in detail together with attached drawings. However, embodiments are not limited to the embodiments disclosed hereinafter, but may be embodied in different modes. The embodiments are provided for perfection of disclosure and informing a scope to persons skilled in this field of art. The same reference numbers may refer to the same elements throughout the specification.

Figure 1:
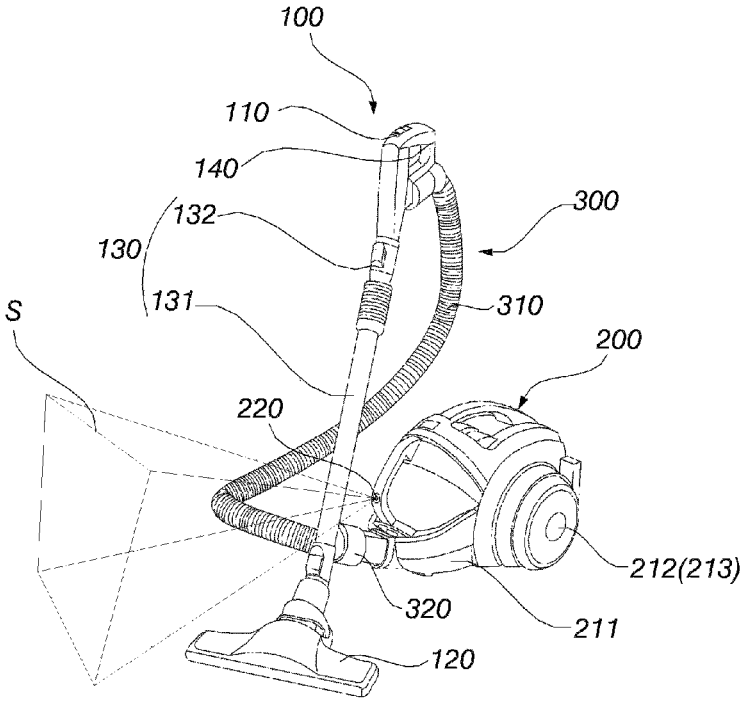
FIG. 1 is a view showing a cleaner according to an embodiment of the present invention.
Figure 2:
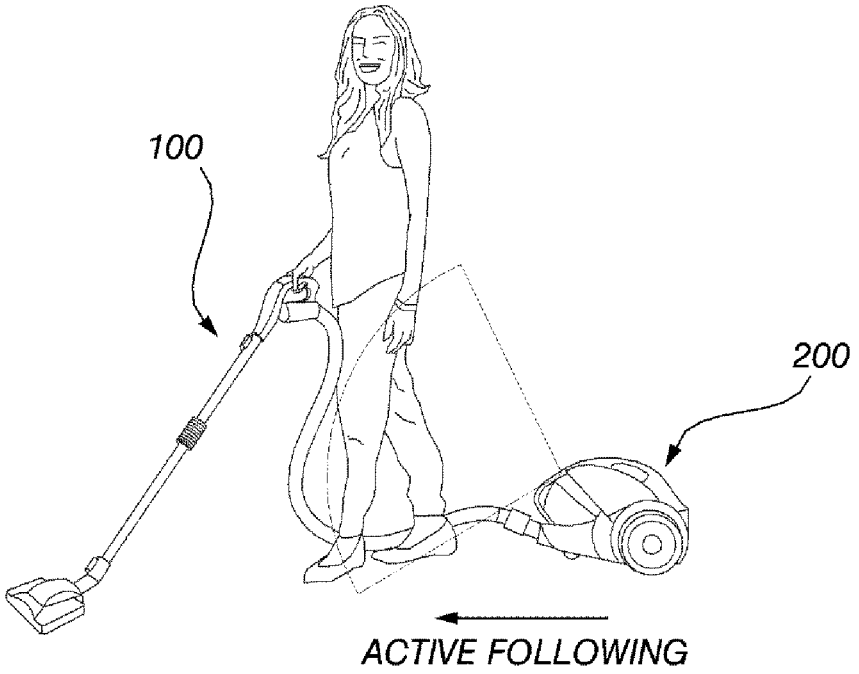
FIG. 2 is a view showing that a main body follows a suction device.
Figure 3:
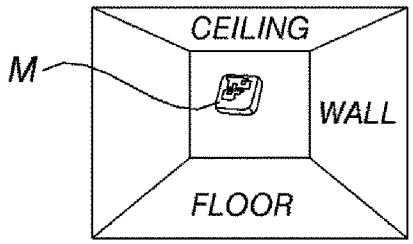
FIG. 3 is a view showing that a marker is indicated in an image for a cleaning zone.
Figure 4:
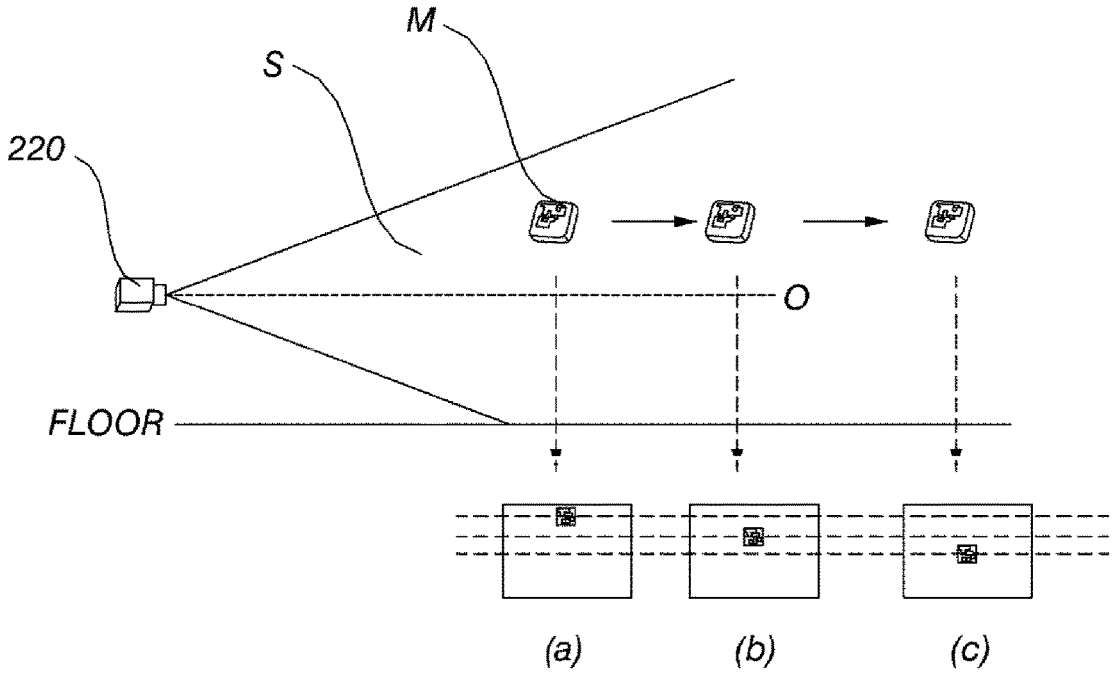
FIG. 4 is a reference view illustrating the change in position of the marker in the image based on the change in distance between the main body and the marker.
Figure 5:
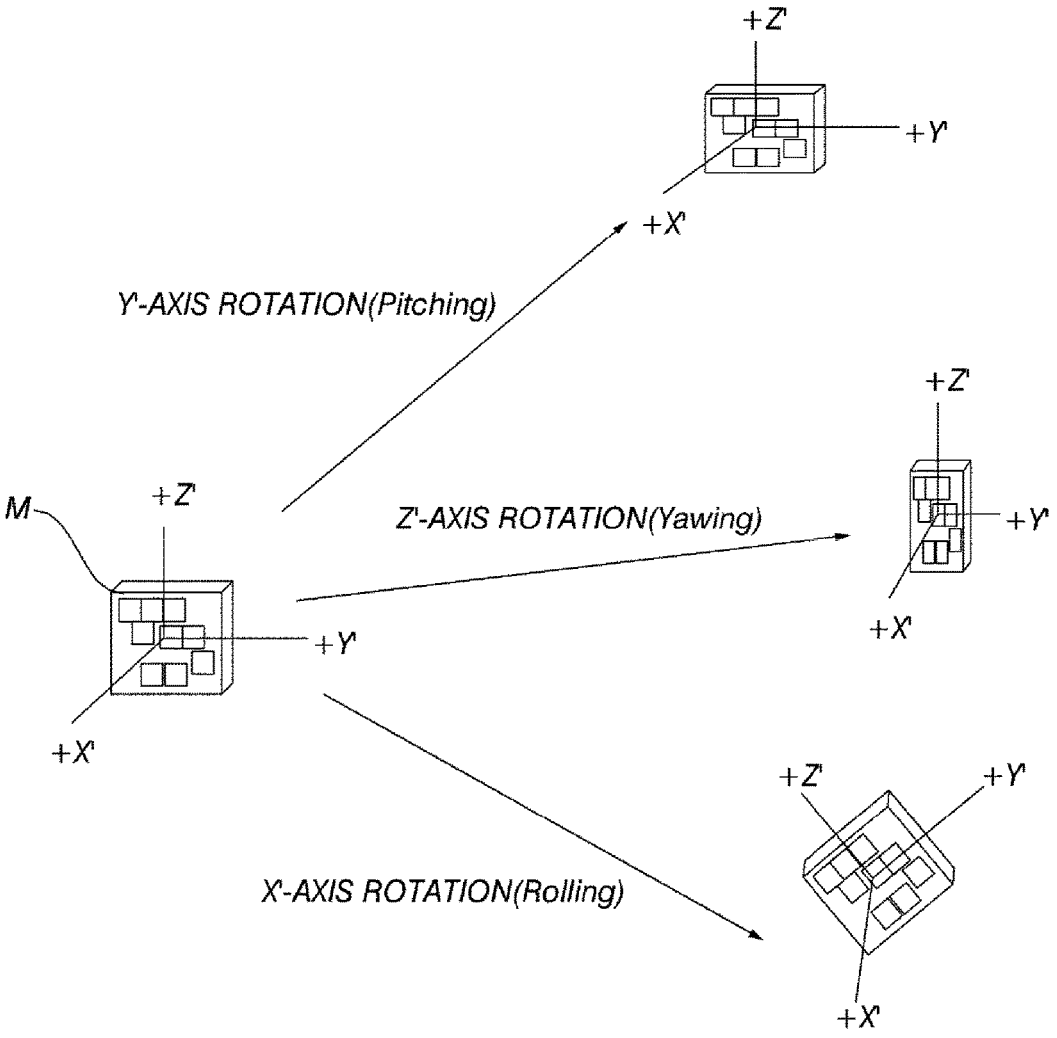
FIG. 5 is a view showing the change in shape of the marker in the image based on the change in attitude of the marker in a real space.
Figure 6:
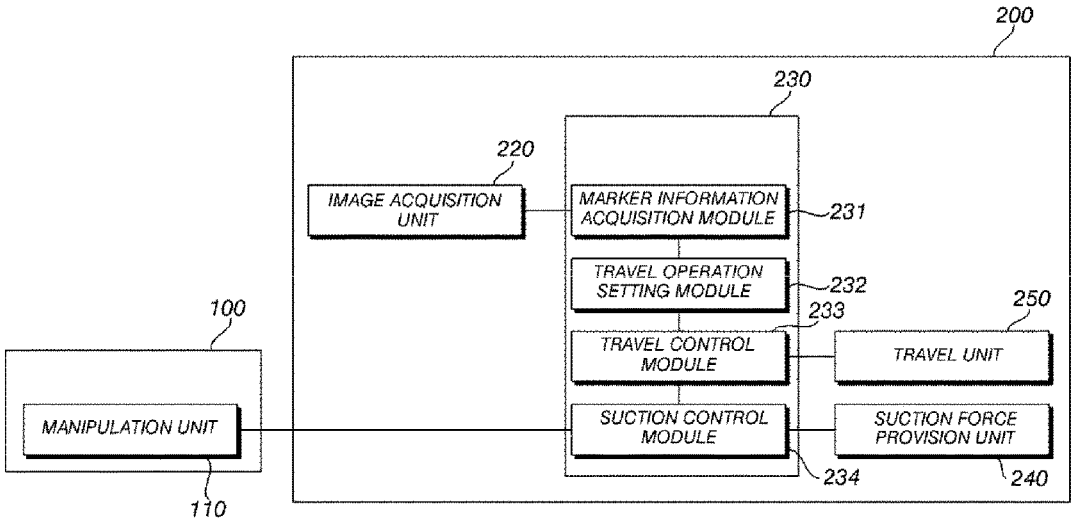
FIG. 6 is a block diagram showing the construction of main parts of the cleaner according to the embodiment of the present invention.

FIG. 1 is a view showing a cleaner according to an embodiment of the present invention. FIG. 2 is a view showing that a main body follows a suction device. FIG. 3 is a view showing that a marker is indicated in an image for a cleaning zone. FIG. 4 is a reference view illustrating the change in position of the marker in the image based on the change in distance between the main body and the marker. FIG. 5 is a view showing the change in shape of the marker in the image based on the change in attitude of the marker in a real space. FIG. 6 is a block diagram showing the construction of main parts of the cleaner according to the embodiment of the present invention.

A cleaner according to an embodiment of the present invention includes a movable body configured to be movable for suctioning dust and a following body for collecting the dust suctioned by the movable body, the following body being mobile. The following body includes an image acquisition unit 220 for acquiring an image for a view around the following body and a controller 230 for controlling the following body to travel while following the movable body based on the acquired image. Referring to FIG. 1, the movable body may be a suction device 100, and the following body may be a main body 200. Hereinafter, by way of example, the movable body will be described as the suction device 100, and the following body will be described as the main body 200.

Referring to FIG. 1, a cleaner according to an embodiment of the present invention may include a suction device 100 and a main body 200. The suction device 100 is connected to the main body 200 via a hose 300. Air suctioned by the suction device 100 is introduced into the main body 200 via the hose 300. The main body 200 may be provided with a dust collector (not shown) for collecting dust from the air introduced into the main body 200 via the hose 300. The suction device 100 may be provided with a suction port (not shown), through external air is suctioned into the suction device 100. The main body 200 may provide suction force via the hose 300 such that the external air can be suctioned into the suction device 100 through the suction port. The suction device 100 is moved along a floor according to manipulation of a user.

The suction device 100 may include a suction unit 120 configured such that the suction port, through which dust is suctioned into the suction device 100, faces a floor of a cleaning zone, an intake pipe 130 extending from the suction unit 120 for defining a channel along which the dust suctioned through the suction port moves, and a handle 140 provided at the upper part of the intake pipe 130. A user may push or pull the suction device 100 while holding the handle 140 to move the suction device 100.

The intake pipe 130 forms a channel along which air suctioned through the suction unit 120 moves. The intake pipe 130 may include a lower pipe 131 connected to the suction unit 120 and an upper pipe 132 slidably connected to the lower pipe 131. As the upper pipe 132 slides along the lower pipe 131, the overall length of the intake pipe 130 may be varied. The handle 140 is configured to be located higher than the waist of the user during cleaning. In this embodiment, the handle 140 is provided at the upper pipe 132.

Air is introduced through one end of the hose 300 connected to the intake pipe 130 and is discharged through the other end of the hose 300 connected to the main body 200. The hose 300 may include a flexible portion 310. The flexible portion 310 may be bent according to movement of the suction device 100. The position of the suction device 100 relative to the main body 200 may be varied according to manipulation of the user. Since the suction device 100 is moved within a length of the hose 300, however, the suction device 100 cannot be distant more than a predetermined distance from the main body 200.

The hose 300 includes a main body connection unit 320 connected to the main body 200. The main body connection unit 320 may be rigid body. The main body connection unit 320 is moved along with the main body 200. The main body connection unit 320 may be separably coupled to the main body 200.

The main body 200 may include a case 211 forming the external appearance of the main body 200 and at least one wheel rotatably mounted at the case 211. The main body 200 may move straight and turn using the wheel. In this embodiment, a left wheel 212 and a right wheel 213 are provided at left and right sides of the case 211, respectively. The main body 200 may turn based on a difference in rotational speed between the left wheel 212 and the right wheel 213.

The main body 200 may further include a travel unit 250 for rotating the left wheel 212 and the right wheel 213. The travel unit 250 may include at least one motor. According to embodiments, a pair of motors may be provided to drive the left wheel 212 and the right wheel 213. Alternatively, the travel unit 250 may include a motor and a power transmission unit for transmitting drive force from the motor to the left wheel 212 and the right wheel 213. In the former case, the main body 200 may turn based on a difference in rotational speed between the motors. In the latter case, the main body 200 may turn based on a difference in rotational speed between the left wheel 212 and the right wheel 213 based on the power transmission unit.

The main body 200 may further include a suction force provision unit 240. The suction force provision unit 240 forms negative pressure for the suction device 100 to suction external air. The suction force provision unit 240 may include a fan motor (not shown) and a fan (not shown) rotated by the fan motor. The fan motor may be driven under control of a suction control module 234 of a controller 230. The suction force provision unit 240 may be provided in the case 211. In addition, the dust collector (not shown) for collecting dust suctioned through the hose 300 may be disposed in the case 211.

The suction device 100 may further include a manipulation unit 110. The manipulation unit 110 allows the user to input various control commands. In particular, it is possible to control the operation of the suction force provision unit 240 through the manipulation unit 110. The position of the manipulation unit 110 is set such that the manipulation unit 110 can be manipulated by the thumb of the user holding the handle 140. In this embodiment, the manipulation unit 110 is provided at the handle 140. However, the present invention is not limited thereto. The suction control module 234 may control the operation of the suction force provision unit 240 according to a control command input through the manipulation unit 110.

The image acquisition unit 220 acquires an image for a view around the main body 200. For example, the image acquisition unit 220 may acquire an image for a view ahead of the main body 200 (or in a travel direction of the main body 200). The image acquisition unit 220 may include a camera. For example, the image acquisition unit 220 may include a digital camera that is capable of acquiring a digital image. The digital camera may be configured such that an optical axis O (see FIG. 4) of a lens of the digital camera faces ahead of the main body 200.

The controller 230 controls the main body 200 to travel while following the suction device 100 based on the image acquired by the image acquisition unit 220. The controller 230 may include a marker information acquisition module 231, a travel operation setting module 232, a travel control module 233, and/or a suction control module 234. These modules will hereinafter be described in more detail.

Meanwhile, the movement of the main body 200 may be classified as a passive movement of the main body 200 in which the main body 200 is moved by tension from the user or an active movement of the main body 200 in which the wheels 212 and 213 of the main body 200 are rotated by the motor. The term "following" or "active following" used in the following description is based on the active movement of the main body 200.

The travel unit 250 may include a clutch for transmitting drive force from the motor to the wheels 212 and 213. Drive force from the motor may be transmitted to the wheels 212 and 213 according to the operation of the clutch with the result that the active movement of the main body 200 may be achieved. On the other hand, the passive movement of the main body 200 may be achieved in a state in which the transmission of the drive force from the motor to the wheels 212 and 213 is released.

The cleaner according to the embodiment of the present invention may include a marker M displaced according to the movement of the suction device 100. The controller 230 may control the travel operation of the main body 200 based on the position (or attitude) of the marker M indicated in the image acquired by the image acquisition unit 220. The image acquisition unit 220 may repeatedly acquire images during travel of the main body 200. In this case, controller 230 may control the travel operation of the main body 200 based on the acquired images even during travel of the main body 200. Even when the position or the attitude of the marker M is changed during travel of the main body 200, therefore, the controller 230 may sense the change in position or attitude of the marker M based on the images and reset the travel operation of the main body 200 based on the sensed change in position or attitude of the marker M. As a result, the main body 200 is moved based on the reset travel operation of the main body 200. Consequently, it is possible for the main body 200 to follow the marker M.

Referring to FIGS. 3 to 5, when the user cleans the floor while moving the suction device 100, the marker M is also moved according to the movement of the suction device 100. As a result, the position (see FIG. 4) or the attitude (see FIG. 5) of the marker M in the image acquired by the image acquisition unit 220 (hereinafter, referred to as the acquired image) is also varied.

More specifically, the position of the marker M indicated in the acquired image reflects position information of the marker M in a real space. The position information may include information regarding a distance from the main body 200 to the marker M or information regarding a direction in which the marker M is positioned relative to the main body 200. The marker information acquisition module 231 may acquire the position information of the marker M in the real space based on the position of the marker M indicated in the image acquired by the image acquisition unit 220.

Since the image acquisition unit 220 has a fixed visual field, and the height from the floor to the marker M in the real space is not substantially too much changed, the position in the vertical direction of the marker M indicated in the acquired image reflects a distance between the main body 200 and the marker M in the real space. For example, as the position of the marker M in the image at a region above the optical axis O is moved more downward, the marker M is more distant from the main body 200 in the real space. Distances from the main body 200 to points in the real space corresponding to coordinates in the image may be prestored as a database, and the marker information acquisition module 231 may acquire information regarding the distance to the marker M based on the database.

In addition, the position in the horizontal direction of the marker M in the image reflects a direction in which the marker M is positioned relative to the main body 200 in the real space. For example, in a case in which the marker M is positioned in the image at the left side on the basis of a vertical line passing through the optical axis O, the marker M is positioned at the left side of the main body 200 in the real space. On the other hand, in a case in which the marker M is positioned in the image at the right side, the marker M is positioned at the right side of the main body 200 in the real space. Direction from the main body 200 to points in the real space corresponding to coordinates in the image may be prestored as a database, and the marker information acquisition module 231 may acquire information regarding the direction in which the marker M is positioned relative to the main body 200 based on the database.

The travel operation setting module 232 may set a travel operation of the main body 200 such that the main body 200 follows the suction device 100 based on the position information. Since the position information may include the information regarding the distance from the main body 200 to the marker M and/or the information regarding the direction in which the marker M is positioned relative to the main body 200 as described above, the travel operation of the main body 200 may be set according to a distance by which the main body 200 will be moved and/or a direction in which the main body 200 will be moved, calculated based on the distance information and/or the direction information.

The travel control module 233 may control the travel of the main body 200 according to the set travel operation. As the travel unit 250 is controlled by the travel control module 233, the main body 200 follows the suction device 100 while moving according to the set travel operation. The movement of the main body 200 is not necessarily achieved until the main body 200 reaches the suction device 100. Since the user is generally located between the main body 200 and the suction device 100, it is sufficient for the main body 200 to move to a position spaced apart from the suction device 100 by a predetermined distance. For example, in a case in which the length of the hose 300 is 1 m, the main body 200 may move to a position spaced apart from the suction device 100 by about 40 to 60 cm and then be stopped. The distance between the main body 200 and the suction device 100 may be measured on the floor. The distance between the main body 200 and the suction device 100 may be calculated based on the position of the marker M indicated in the image.

Referring to FIG. 4, the change in position of the marker M indicated in the acquired image reflects the movement of the marker M in the real space. For example, as shown in FIG. 4, as the marker M is more distant from the main body 200 in the real space, the position of the marker M in the image at the region above the optical axis O is moved more downward. Information regarding the movement of the marker M in the real space may be acquired based on the change in position of the marker M indicated in the image. Of course, the movement information may include the change in direction in which the marker M is moved as well as the change in distance from the main body 200 to the marker M.

Referring to FIG. 4, as the marker M is more distant from the main body 200 within a visual field S of the image acquisition unit 220, the position of the marker M in the acquired image is moved more downward. In this case, however, the marker M is positioned above the optical axis O of the image acquisition unit 220. On the other hand, in a case in which the marker M is positioned below the optical axis O of the image acquisition unit 220 (for example, the marker M is moved along the floor), as the marker M is more distant from the main body 200, the position of the marker M in the acquired image is moved more upward.

The marker information acquisition module 231 extracts the marker M from the acquired image to acquire movement information of the marker M. The travel operation setting module 232 sets a travel operation in which the main body 200 approaches the marker M or a travel route along which the main body 200 approaches the marker M based on the movement information of the marker M.

In the same manner as in the case in which the travel of the main body 200 is controlled based on the position of the marker M indicated in the image as described above, the travel operation setting module 232 may set the travel operation of the main body 200 based on the movement information of the marker M, and the travel control module 233 controls the travel unit 250 according to the set travel operation of the main body 200. As a result, the main body 200 follows the suction device 100.

Referring to FIG. 5, the shape of the marker M in the acquired image is changed based on the attitude of the marker M in the real space. At this time, the attitude of the marker M is changed based on movement patterns of the marker M or a portion at which the marker M is disposed. The movement patterns may include a pitching pattern, a yawing pattern, and a rolling pattern. In a case in which the marker M is properly configured, it is possible to estimate a movement pattern of the marker M or the portion at which the marker M is disposed based on the change in shape of the marker M indicated in the acquired image.

For example, it is assumed that a three-dimensional X'Y'Z' moving Cartesian coordinate system (based on a right hand) is defined on the basis of the marker M, and the marker M is viewed in an −X' direction as shown in FIG. 5. In this case, pitching is a Y'-axis rotation. As shown, the length of the marker M in a Z' direction seems to be changed according to the pitching. Yawing is a Z'-axis rotation. As shown, the length of the marker M in a Y' direction seems to be changed. Rolling is an X'-axis rotation. As shown, the marker M seems to be rotated.

The marker information acquisition module 231 may further acquire information regarding the change in attitude of the marker M in the real space based on the change in shape of the marker M indicated in the acquired image. In this case, the travel operation setting module 232 may set the travel operation of the main body 200 based on the attitude change information of the marker M, and the travel control module 233 may control the travel unit 250 to travel the main body 200 according to the set travel operation of the main body 200. The attitude change information of the marker M will hereinafter be described in more detail with reference to FIGS. 11 and 12.

Figure 7:
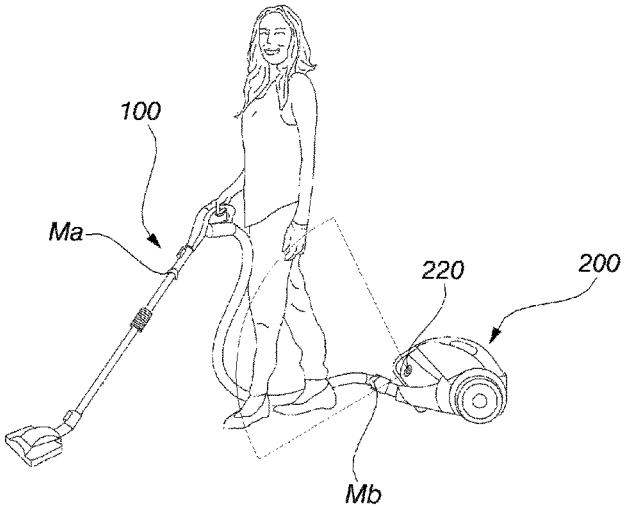
FIG. 7 is a view showing the positions of markers according to an embodiment of the present invention.
Figure 8:
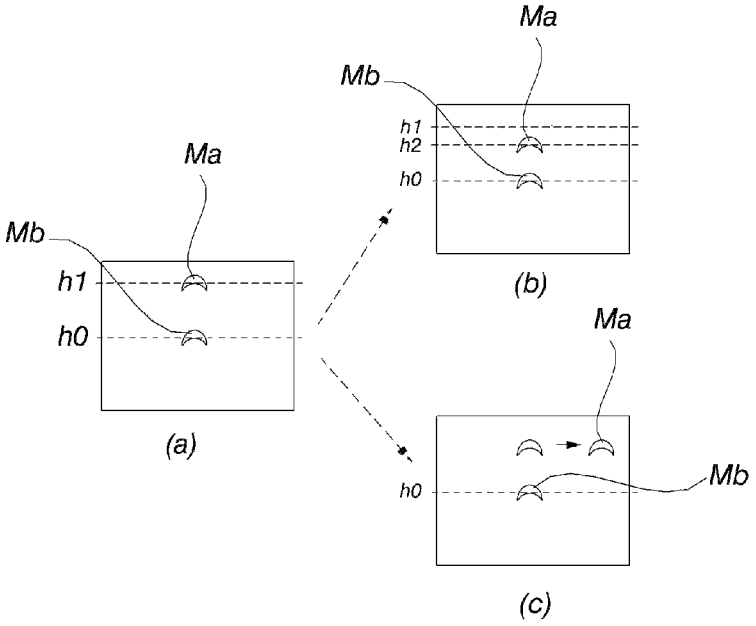
FIG. 8 is a view showing the change in position of the markers of FIG. 7 in the image based on the movement of the suction device.

FIG. 7 is a view showing the positions of markers according to an embodiment of the present invention. FIG. 8 is a view showing the change in position of the markers of FIG. 7 in the image based on the movement of the suction device. Referring to FIGS. 7 and 8, the cleaner may include a first marker Ma disposed at the suction device 100 and a second marker Mb disposed at the main body 200 or at a portion having a fixed position relative to the main body 200. The second marker Mb may be disposed at a position usually belonging to the visual field of the image acquisition unit 220 irrespective of the movement of the suction device 100 or the deformation of the hose 300. In this embodiment, the first marker Ma is disposed at the upper pipe 132 of the intake pipe 130, and the second marker Mb is disposed at the main body connection unit 320 of the hose 300. However, the present invention is not limited thereto.

As the suction device 100 becomes distant from the main body 200 in a state in which the first marker Ma and the second marker Mb are positioned in the acquired image as shown in FIG. 8(*a*), the position of the first marker Ma is lowered (h2<h1) while the position of the second marker Mb in the acquired image is not changed with the result that the distance between the first marker Ma and the second marker Mb is decreased as shown in FIG. 8(*b*).

FIG. 8(*c*) shows a case in which the suction device 100 is moved from the position shown in FIG. 8(*a*) to the right in the real space. The marker information acquisition module 231 may acquire information regarding the change in distance between the suction device 100 and the main body 200 and/or the direction in which the suction device 100 is moved relative to the main body 200 in the real space based on the displacement of the first marker Ma or the change in position between the first marker Ma and the second marker Mb in the acquired image.

In particular, since the position of the first marker Ma in the acquired image reflects the distance from the first marker Ma to the main body 200 in the real space, the marker information acquisition module 231 may acquire information regarding the position of the first marker Ma in the acquired image, and estimate the distance from the main body 200 to the suction device 100 based on the acquired position information of the first marker Ma.

Meanwhile, the suction device 100 is always placed on the floor during cleaning. At this time, however, the intake pipe 130 may be pivoted on the floor. As a result, the first marker Ma may be moved upward and downward in the acquired image even when the suction device 100 is not actually moved. In this case, therefore, the distance from the main body 200 to the suction device 100 calculated by the marker information acquisition module 231 may be different from a real distance between the main body 200 and the suction device 100. In a normal situation, however, the user holds the handle 140 at the rear of the suction unit 120 in a state in which the suction port faces the floor of the cleaning zone. For this reason, the height from the floor to the first marker Ma is almost uniform. Even if the height of the first marker Ma is varied according to the pivot operation of the intake pipe 130, a displacement range of the first marker Ma is limited. Consequently, it is possible to control the active following operation of the main body 200 with sufficient accuracy.

The marker information acquisition module 231 may acquire information regarding the change in distance from the suction device 100 to the main body 200 in the real space based on the change in distance between the first marker Ma and the second marker Mb in the acquired image. In a case in which the distance change information reflects that the suction device 100 becomes distant from the main body 200 (see FIG. 8(*b*)), the travel operation setting module 232 may set the travel operation of the main body 200 such that the main body 200 is moved forward to the suction device 100, and the travel control module 233 may control the travel unit 250 according to the set travel operation (forward movement) of the main body 200.

The marker information acquisition module 231 may acquire information regarding the change in direction of the suction device 100 in the real space based on the horizontal displacement of the first marker Ma relative to the second marker Mb in the acquired image. In this case, the travel operation setting module 232 sets the travel direction of the main body 200 such that the main body 200 turns in the changed direction of the suction device 100, and the travel control module 233 controls the travel unit 250 according to the set travel operation (change in direction) of the main body 200.

Figure 9:
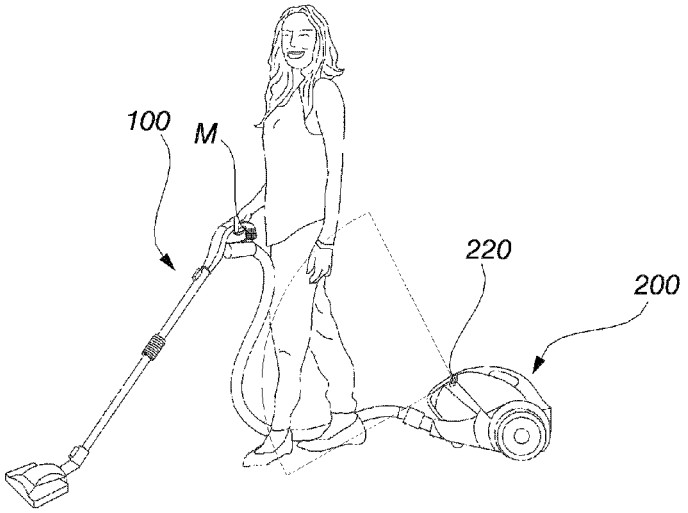
FIG. 9 is a view showing the position of a marker according to another embodiment of the present invention.

FIG. 9 is a view showing the position of a marker according to another embodiment of the present invention. Referring to FIG. 9, the marker M may be disposed at the suction device 100. Specifically, the marker M may be disposed at the upper end of the suction device 100. In this embodiment, the marker M is disposed at the handle 140. However, the present invention is not limited thereto. For example, the marker M may be disposed at a place exposed to the visual field of the image acquisition unit 220 as frequently as possible (i.e. a region rarely hidden by the user) in consideration of a general movement line of the user during cleaning. In this aspect, the handle 140 is suitable for a position at which the marker M is disposed since the hand of the user holding the handle 140 is exposed to the visual field of the image acquisition unit 220 as the hand of the user is naturally located beside the body of the user.

Figure 10:
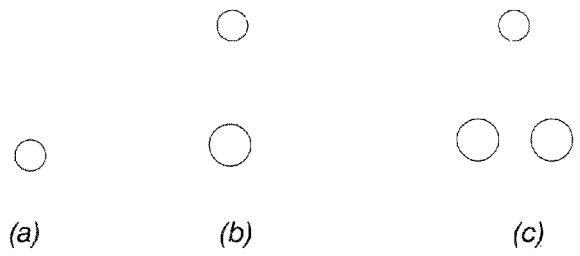
FIG. 10 is a view showing configurations of a marker according to embodiments of the present invention.

FIG. 10 is a view showing configurations of a marker according to embodiments of the present invention. Referring to FIG. 10, the marker M may have various identification patterns. Hereinafter, a factor, such as a point, a line, or a plane, constituting the patterns will be defined as a marker component. The marker may have an identity, by which the marker is obviously distinguished from a background. In addition, such an identity may not be affected by lighting around the marker. The marker may have a point, a line, a contour, an area, or a combination thereof as a marker component.

The marker M may be brighter than the background in consideration of an identity of the marker M distinguished from the background. In this aspect, the marker M may be classified as a reflective type marker which reflects light around the marker to have an identity of higher luminance than the background or a self emissive type marker which self-emits light.

The reflective type marker M may be formed by applying a highly reflective paint to a surface of an object. Alternatively, the reflective type marker M may be formed by attaching a highly reflective material to the surface of the object. The reflective type marker has an advantage in that a position to which the reflective type marker is attached is not limited. In a low illuminance environment, however, the reflective type marker M has a low identity. For this reason, a lighting device for illuminating the marker M may be further provided. The lighting device may be provided at the main body 200 for illuminating ahead of the main body 200.

The self emissive type marker M has a light source configured to electrically emit light. A light emitting diode (LED) or an infrared light source may be used as the light source. The self emissive type marker M has an advantage in that the self emissive type marker M can be identified even in a low illuminance environment.

FIG. 10 shows marker components, each of which is constituted by a point having a contour. FIG. 10(*a*) shows a case in which one marker component constitutes one marker, FIG. 10(*b*) shows a case in which two marker components constitute one marker, and FIG. 10(*c*) shows a case in which three marker components, which are arranged in the shape of a triangle, constitute one marker. In the following description, it is assumed that the marker components are points for convenience of description.

The change in position or shape of the marker indicated in the acquired image is complicated as a degree of freedom (dof) of the portion at which the marker is disposed is increased. Consequently, it is necessary to consider the degree of freedom of the portion at which the marker is disposed when designing patterns of the marker.

In this aspect, since the marker of FIG. 10(*a*) is constituted by one point, the movement of the marker that can be recognized through the acquired image is limited to translation of the marker based on coordinates of the point.

Since the marker of FIG. 10(*b*) is constituted by two points, it is possible to further recognize rotation of the marker based on the change in distance between the two points. For example, it is possible to recognize pitching and yawing as previously described with reference to FIG. 5.

Since the marker of FIG. 10(*c*) is constituted by three points, it is possible to further recognize rolling. In addition, it is also possible to recognize similarity based on the change in area of a triangle constituted by the three points, and therefore it is possible to estimate the change in area of the triangle according to zooming, etc.

Since it is possible to recognize higher degree of freedom movement of the marker or the portion at which the marker is disposed as the number of the marker components constituting the marker is increased, the marker may include an appropriate number of marker components based on movement of the marker to be recognized.

Figure 11:
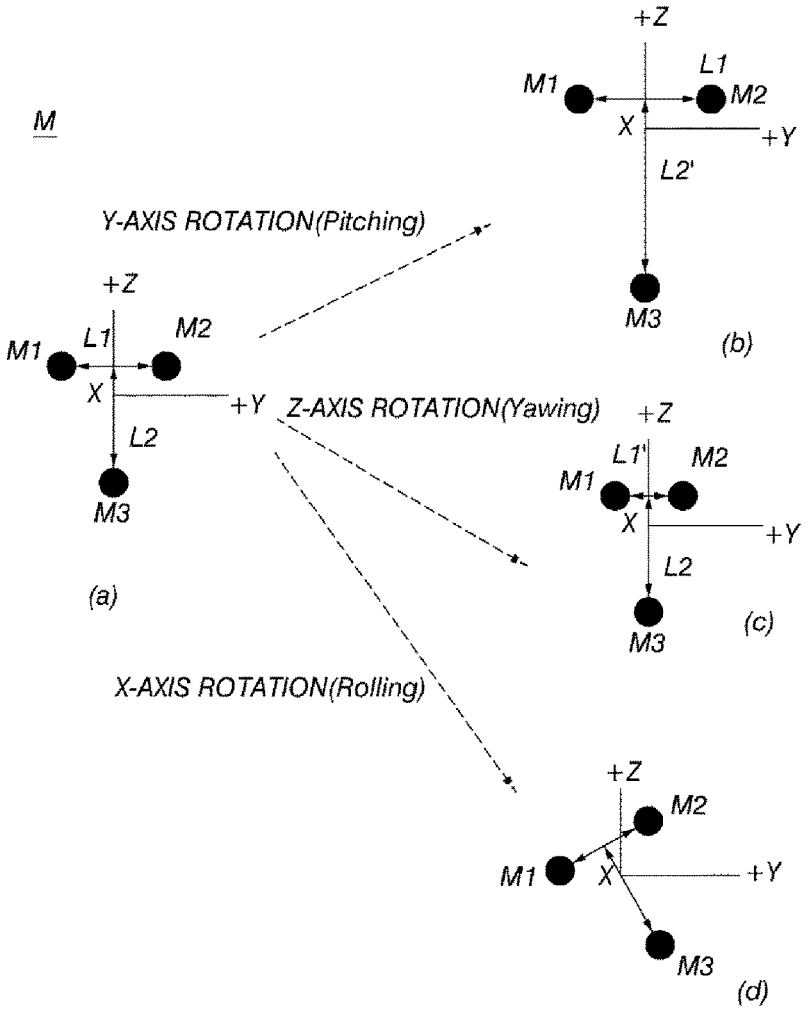
FIGS. 11 and 12 are views showing the change in shape of the marker in an acquired image based on the change in attitude of the marker of FIG. 10(*c*)
Figure 12:
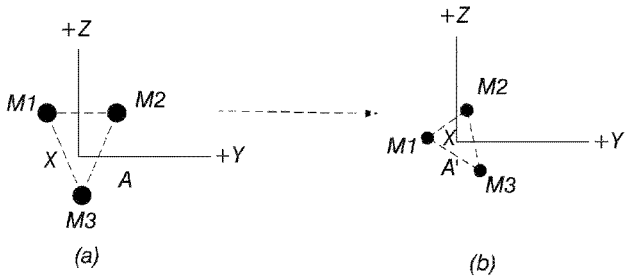

FIGS. 11 and 12 are views showing the change in shape of the marker in the acquired image based on the change in attitude of the marker of FIG. 10(*c*). FIG. 11(*a*) shows that a marker including three marker components (for example, points) M1, M2, and M3 as shown in FIG. 10(*c*) is indicated in the acquired image. X, Y, and Z shown in FIG. 11(*a*) constitute a three-dimensional Cartesian coordinate system (based on a right hand). The acquired image corresponds to a YZ plane. In the following description, the marker M is disposed at the handle 140.

In case of which the marker M includes 2 marker components, the marker information acquisition module 231 may acquire rotation information of the marker for an axis orthogonal to an optical axis O of the image acquisition unit 220 in the real space based on a change in vertical distance between two marker components indicated in the acquired image. Especially, when the marker M includes tree marker component M1, M2 and M3, the marker information acquisition module 231 may acquire rotation information of the marker for an axis (Y in FIG. 11) orthogonal to an optical axis O of the image acquisition unit 220 in the real space based on a change in distance from one (M3) of the three marker components indicated in the image to a segment formed by the other two (M1, M2) of the tree marker components.

FIG. 11(*b*) shows a phase of the marker M changed according to pitching (Y-axis rotation) of the handle 140 in the acquired image. It can be seen from FIG. 11(*b*) that the distance from a straight line interconnecting the marker components M1 and M2 to the marker component M3 has been changed from L2 to L2'. The marker information acquisition module 231 may acquire information regarding a Y-axis rotation angle of the handle 140 based on the change in distance between the line interconnecting the marker components M1 and M2 and the marker component M3.

FIG. 11(*c*) shows a phase of the marker M changed according to yawing (Z-axis rotation) of the handle 140 in the acquired image. It can be seen from FIG. 11(*c*) that the distance between the marker components M1 and M2 has been changed from L1 to L1'. The marker information acquisition module 231 may acquire information regarding a Z-axis rotation angle of the handle 140 based on the change in distance between the marker components M1 and M2.

FIG. 11(*d*) shows a phase of the marker M changed according to rolling (X-axis rotation) of the handle 140 in the acquired image. It can be seen from FIG. 11(*d*) that all of the marker components M1, M2, and M3 have been rotated in a state in which relative positions among the marker components M1, M2, and M3 are maintained. The marker information acquisition module 231 may acquire information regarding an X-axis rotation angle of the handle 140 based on the rotation angles of the marker components.

FIG. 12 shows similarity of a pattern recognized from the marker M including three marker components. FIG. 12(*a*) shows a triangle constituted by the three marker components in the acquired image, and FIG. 12(*b*) shows a state in which the marker M is rolled and thus changed as the marker M becomes distant from the main body 200. It can be seen from FIG. 12(*b*) that the area of a region, i.e. a triangle, defined by the three marker components in the acquired image has been reduced from A to A'.

It is possible to recognize a distance from the main body 200 to the handle 14 based on the position of the marker M and to recognize a direction in which the handle 140 is moved relative to the main body 200 based on the displacement of the marker M in addition to the various movements of the marker M including the three marker components as described above with reference to FIGS. 11 and 12.

Figure 13:
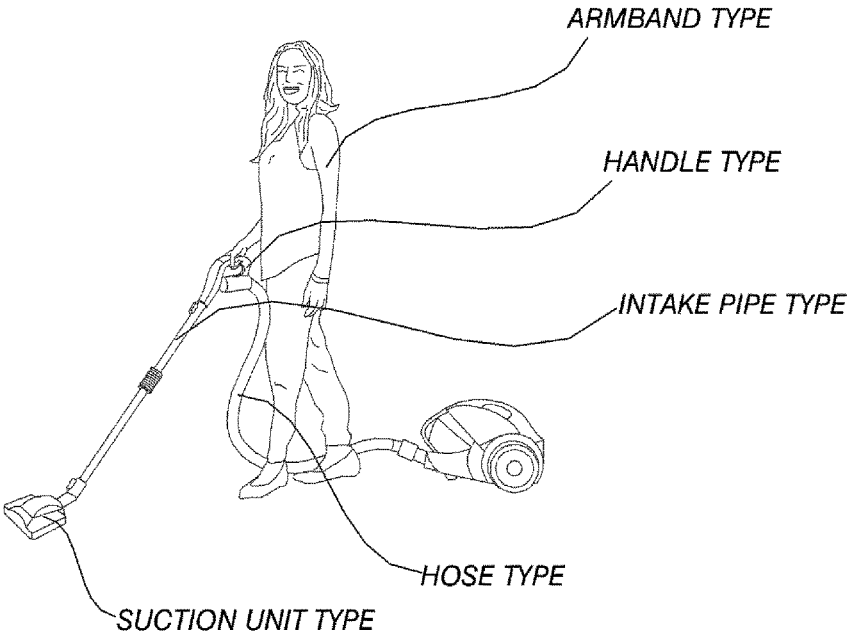
FIG. 13 is a reference view illustrating places at which the marker may be disposed.

Referring to FIG. 13, the marker M may be disposed at the handle 140, the intake pipe 130, the suction unit 120, or the hose 300. (In the figure, the marker M is shown as a handle type marker, an intake pipe type marker, a suction unit type marker, or a hose type marker.) In addition, the marker M may be attached to a body of the user. For example, the marker M may be provided in the form of an armband (an armband type marker of FIG. 13).

Figure 14:
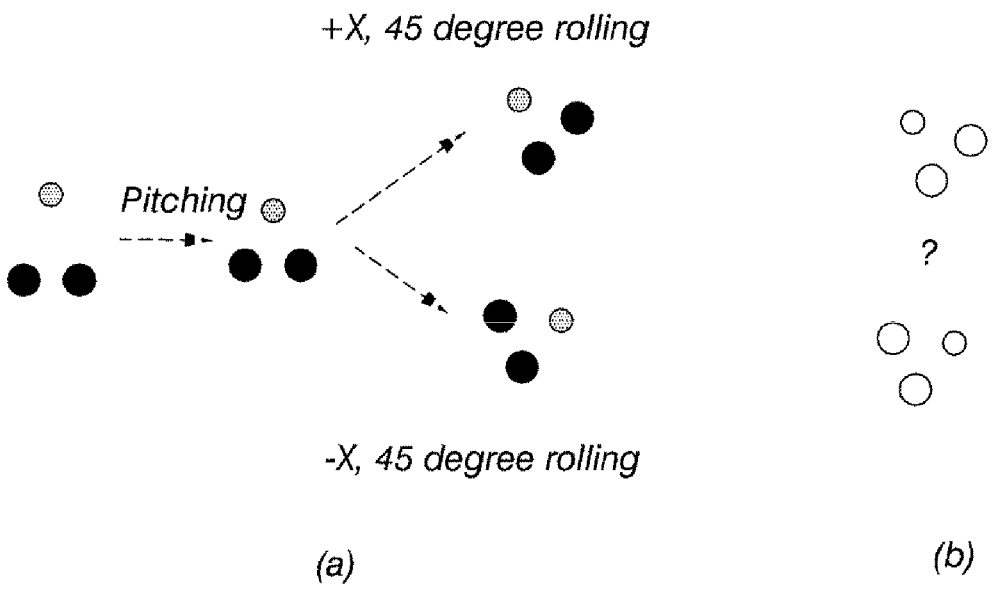
FIGS. 14 and 15 are views showing configurations of the marker according to other embodiments of the present invention.
Figure 15:
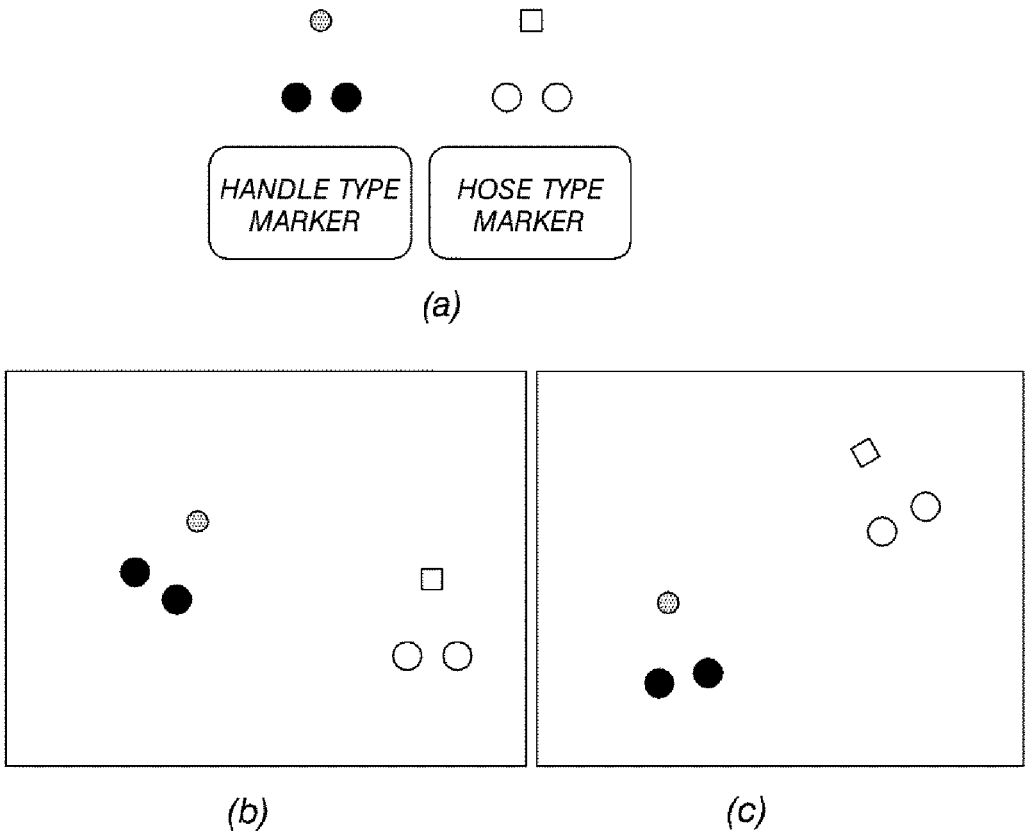

FIGS. 14 and 15 are views showing configurations of the marker according to other embodiments of the present invention. Referring to FIG. 14, the marker M may include marker components having different colors. In this case, it is possible for the marker information acquisition module 231 to more accurately acquire information regarding the change in phase of the marker M. The marker shown in FIG. 14(*a*) includes one grey marker component M1 and two black marker components M2 and M3. The marker is configured to have an isosceles triangular structure in which the distance between the grey marker component M1 and one of the black marker components M2 and M3 (the distance between M1 and M2 or the distance between M1 and M3) is different from that between the black marker components M2 and M3. A case in which the marker is rotated about a +X axis by 45 degrees (+X, 45 degree rolling) after the position of the grey marker component M1 is changed according to pitching of the marker with the result that the marker components M1, M2, and M3 are disposed at vertices of an equilateral triangle and a case in which the marker is rotated about a −X axis by 45 degrees (−X, 45 degree rolling) after the position of the grey marker component M1 is changed according to pitching of the marker with the result that the marker components M1, M2, and M3 are disposed at the vertices of the equilateral triangle are compared. As shown in the figure, in both a case in which the marker is rotated about the +X axis by 45 degrees and a case in which the marker is rotated about the −X axis by 45 degrees, the marker components are disposed to have an equilateral triangular structure. Since the marker component M1 has a color different from that of the marker component M2 or M3, however, it is possible to recognize a direction in which the marker is rotated in both the cases. On the other hand, in a case in which the marker components have the same color, as shown in FIG. 14(*b*), the shape of the marker after pitching of the marker is identical to or very similar to that of the marker after rolling of the marker with the result that it is difficult for the marker information acquisition module 231 to accurately recognize a direction in which the marker is rolled in both the cases. For this reason, different colors are given to the marker components so as to recognize even the change in attitude of the marker, which is difficult to recognize through only the arrangement structure of the marker components.

The marker may include marker components having different shapes. Even in this case, a shape characteristic of the marker components is provided in addition to the arrangement structure of the marker components in the same manner as in the case in which the marker components have different colors. Consequently, it is possible to increase information that can be acquired by the marker information acquisition module 231.

A plurality of markers M may be provided. In this case, the markers M may have different features. These features may include a structural feature (for example, the arrangement structure of the marker components) as described above, a difference in shape between the markers or among the marker components, and a difference in color among the marker components. The marker information acquisition module 231 may estimate movement of the respective parts of the cleaner at which the markers are disposed based on information regarding the position of the markers, the movement of the markers, and the change in shape between the markers acquired through the acquired image. FIG. 15 shows such an example. Specifically, FIG. 15 shows images acquired in a case in which one of two markers, which are different from each other in terms of the shape and color of the marker components, is disposed at the handle 140, and the other marker is disposed at the hose 300 (see FIG. 15(*a*)). The handle 140 and the hose 300 are moved according to the movement of the suction device 100 during cleaning with the result that a positional relationship between the markers is changed from the positional relationship between the markers as shown in an acquired image (b) to the positional relationship between the markers as shown in another acquired image (c). In this case, the marker information acquisition module 231 may recognize the markers based on different features of the markers, and estimate movement aspects of the handle 140 and the hose 300 based on the position of the markers, the movement of the markers, and the change in shape between the markers in the acquired image.

In the embodiments as described above, the movement of the suction device 100 is recognized based on the phase information of the marker indicated in the acquired image. On the other hand, the marker information acquisition module 231 may be configured to detect the user from the acquired image. A predetermined template may be configured based on characteristics (for example, two feet extending from one trunk) of a human body, and the marker information acquisition module 231 may extract a shape corresponding to the predetermined template (for example, a shape constituted by the characteristics of the human body) from the acquired image to acquire position information of the user. In this case, the travel operation setting module 232 may set the travel operation of the main body 200 such that the main body 200 follows the user based on the position information of the user, and the travel control module 233 may control the travel unit 250 according to the set travel operation of the main body 200.

Figure 16:
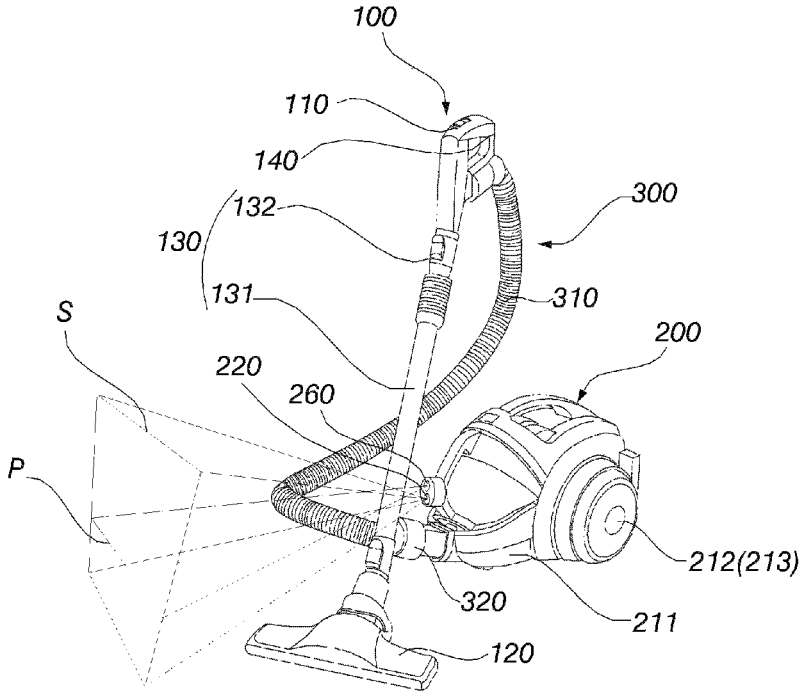
FIG. 16 is a view showing a cleaner according to another embodiment of the present invention.
Figure 17:
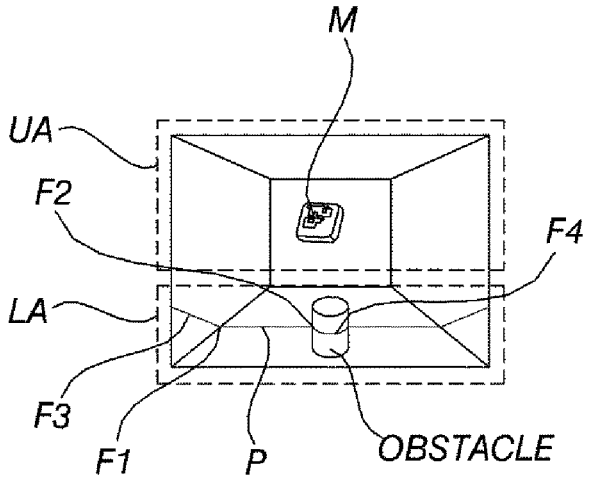
FIG. 17 is a view showing an image taken by the cleaner according to the embodiment of the present invention.
Figure 18:
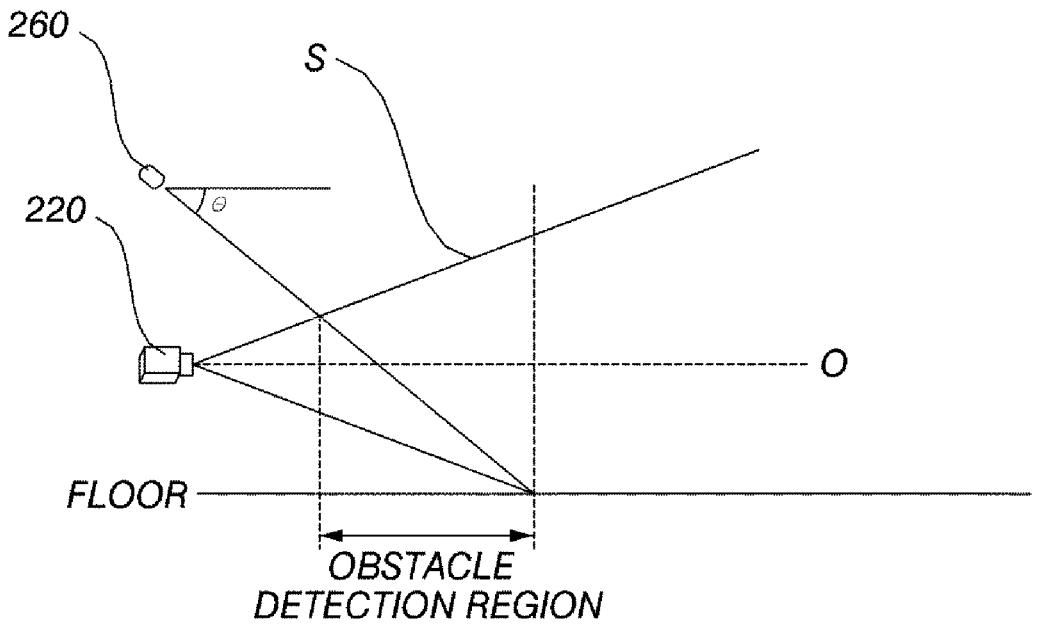
FIG. 18 is a typical view showing an irradiation range of a pattern light irradiation unit.
Figure 19:
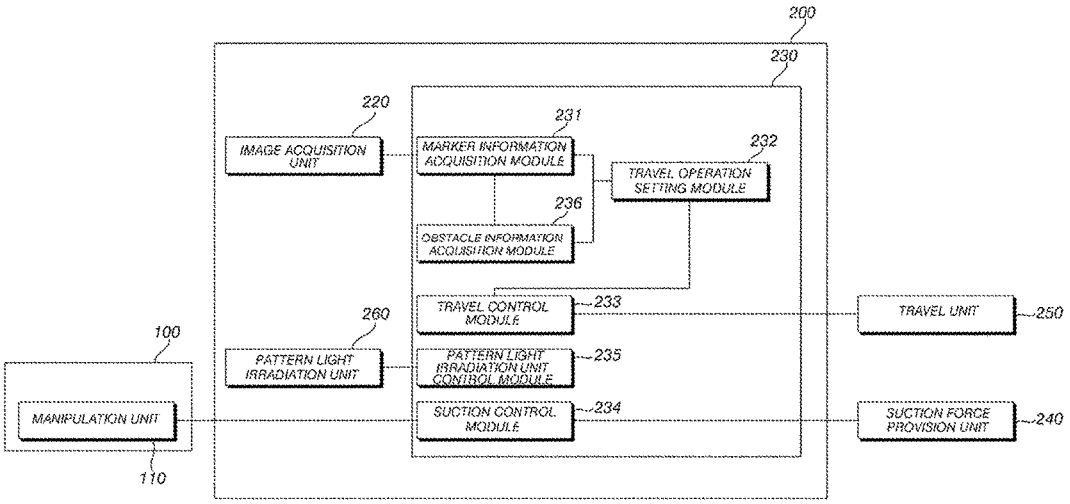
FIG. 19 is a block diagram showing the construction of main parts of the cleaner according to the embodiment of the present invention.

FIG. 16 is a view showing a cleaner according to another embodiment of the present invention. FIG. 17 is a view showing an image taken by the cleaner according to the embodiment of the present invention. FIG. 18 is a typical view showing an irradiation range of a pattern light irradiation unit. FIG. 19 is a block diagram showing the construction of main parts of the cleaner according to the embodiment of the present invention.

Referring to FIGS. 16 to 19, the main body 200 may further include a pattern light irradiation unit 260. The pattern light irradiation unit 260 may include a light source and an optical pattern projection element (OPPE). Light emitted from the light source is transmitted through the optical pattern projection element with the result that a uniform pattern light (hereinafter, referred to as "pattern light") is generated. The light source may be a laser diode (LD) or a light emitting diode (LED). Laser light exhibits monochromaticity, straightness, and connection characteristics superior to other light sources, and therefore accurate distance measurement is possible. However, infrared light or visible light has a problem in that distance measurement accuracy has a great deviation depending upon a factor, such as color or material, of an object. For these reasons, the laser diode (LD) may be used as the light source. The optical pattern projection element may include a mask or a diffractive optical element (DOE). A pattern generated by the optical pattern projection element may include at least one pattern component, such as a point, a line, or a plane.

A pattern light irradiation unit control module 235 controls the pattern light irradiation unit 260. The pattern light irradiation unit control module 235 may control the pattern light irradiation unit 260 to irradiate pattern light not only before the travel of the main body 200 is commenced but also during travel of the main body 200.

Referring to FIG. 18, the pattern light irradiation unit 260 may irradiate a predetermined pattern light ahead of the main body 200. In particular, the pattern light is irradiated slightly downward such that the pattern light is irradiated to the floor of the cleaning zone. In order to form a view angle necessary to detect the distance to an obstacle, an irradiation direction of the pattern light and the optical axis O of the image acquisition unit 220 may not be parallel to each other but form a predetermined angle θ. An obstacle detection region of FIG. 18 is a region at which it is possible to detect an obstacle based on the irradiated pattern light. The possible maximum distance for obstacle detection may be shorter than the length of the hose 300. In addition, the maximum distance for obstacle detection may not reach a position at which the user normally stands.

The controller 230 may further an obstacle information acquisition module 236. Referring to FIG. 17, the obstacle information acquisition module 236 may sequentially compare brightness of points in the acquired image in a horizontal direction to extract a pattern P constituted by points a predetermined level brighter than the surroundings. A lower area LA of the acquired image is an area to which the pattern light is irradiated. The obstacle information acquisition module 236 extracts the pattern P from the lower area LA and acquires information regarding an obstacle in the cleaning zone based on the extracted pattern P. The obstacle information may include information regarding the position of the obstacle, the distance from the main body 200 to the obstacle, the width or height of the obstacle, etc. The lower area LA may be below the optical axis O of the image acquisition unit 220. On the other hand, an upper area UA of the acquired image is an area from which the marker M is extracted. The upper area UA may be above the optical axis O of the image acquisition unit 220.

The controller 230, specifically the obstacle information acquisition module 236, acquires the obstacle information in the real space based on the change in geometry of the pattern (for example, the change in shape of the pattern or the change in position between the pattern components) in the acquired image. In this embodiment, the pattern light irradiation unit 260 irradiates pattern light having a horizontal segment P. The shape of the horizontal segment P may be deformed depending upon a situation of the cleaning zone to which the pattern light is irradiated or a situation of the obstacle. As can be seen from the acquired image shown in FIG. 17, the deformed segment P has a point F1 at which the segment is bent, the point F1 corresponding to an interface between a wall and the floor, a slant line F3 extending along the wall, and a portion F4 of the segment deformed depending upon the shape of the surface of the obstacle. The obstacle information acquisition module 236 may acquire obstacle information based on the various characteristics of the pattern extracted from the acquired image.

A direction in which the pattern light is irradiated by the pattern light irradiation unit 260 is fixed. When the pattern light is irradiated to a region having no obstacle, therefore, the position of a pattern in an acquired image is always uniform. Hereinafter, the acquired image at this time will be referred to as a reference acquired image. Position information of the pattern in the reference acquired image may be pre-calculated using triangulation. On the assumption that coordinates of any pattern component Q constituting the pattern in the reference acquired image are Q(Yi, Zi), a distance value Li(Q) from the main body 200 to the pattern component Q may be pre-calculated using triangulation. Coordinates Q'(Yi', Zi') of the pattern component Q in the acquired image obtained by irradiating a pattern light into a region having an obstacle result from the movement of Q(Yi, Zi) of the pattern component Q in the reference acquired image. The obstacle information acquisition module 236 may compare the coordinates Q'(Yi', Zi') of the pattern component Q with the coordinates Q(Yi, Zi) of the pattern component Q to acquire obstacle information regarding the width and the height of the obstacle and the distance to the obstacle. In particular, it is possible to recognize the width or the shape of the obstacle or the distance to the obstacle based on a view angle or a degree in which the horizontal line constituting the pattern is bent. In addition, it is possible to recognize the height of the obstacle based on the vertical displacement of the horizontal line or the length of the vertical line.

The travel operation setting module 232 may set a travel operation or a travel route of the main body 200 in which the main body 200 can follow the marker M while avoiding the obstacle based on the marker information, such as the position, the movement, and the change in attitude, of the marker acquired by the marker information acquisition module 231 and the obstacle information acquired by the obstacle information acquisition module 236.

The travel control module 233 controls the travel unit 250 such that the main body 20 can travel according to the travel operation or the travel route of the main body 20 set by the travel operation setting module 232. As a result, it is possible for the main body 200 to follow the suction device 100 without collision with the obstacle.

As is apparent from the above description, the cleaner according to the present invention has an effect in that the following body (or the main body) actively follows the movable body (or the suction device) with higher following ability than in a conventional ultrasonic type cleaner.

In addition, the cleaner according to the present invention has another effect in that the following body can accurately follow the movable body in various cleaning zones.

In addition, the cleaner according to the present invention has a further effect in that information regarding movement of the movable body is directly acquired from an image taken from a cleaning zone, and therefore it is possible for the following body to follow the movable body with higher accuracy than in a conventional cleaner in which the movement of the movable body is indirectly estimated.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method comprising:

suctioning dust particles from a movable body of a cleaner, the moveable body comprising a suction unit having a suction port configured to suction the dust particles, an intake pipe extending from the suction unit to define a channel for the dust particles suctioned through the suction port to travel, and a handle provided at an upper part of the intake pipe, the handle having a first marker disposed thereon;

collecting the suctioned dust particles in a following body of the cleaner, the following body being mobile and having a second marker disposed thereon;

guiding the suctioned dust particles from the movable body to the following body through a hose;

acquiring, via an image acquisition unit of the following body, an image of a view around the following body;

providing a drive force, via a travel unit of the following body, for the following body to travel; and acquiring an information regarding a distance between the first marker and the second marker in the acquired image, and setting a travel operation of the following body such that the following body follows the handle based on the acquired information, whereby the acquired information comprises a distance between the first marker and the second marker.

2. The method according to claim 1, further comprising acquiring information regarding the change in distance between the movable body and the following body based on a change of relative position of the first marker to the second marker in the acquired image.

3. The method according to claim 1, further comprising acquiring information regarding a change in distance from the moveable body to the following body in real space based on a change of the distance between the first marker and the second marker in the acquired image, and setting the travel operation of the main body when the distance change exceeds a predetermined distance such that the main body is moved forward towards the moveable body.

4. The method according to claim 1, further comprising acquiring information regarding the change in direction of the moveable body in real space based on a horizontal displacement of the first marker relative to the second marker in the acquired image, and setting a travel direction of the main body such that the main body turns in the changed direction of the moveable body.

* * * * *